US007172683B2

(12) United States Patent
Isayama et al.

(10) Patent No.: US 7,172,683 B2
(45) Date of Patent: Feb. 6, 2007

(54) METHOD OF MANAGING A PLATING LIQUID USED IN A PLATING APPARATUS

(75) Inventors: Yasushi Isayama, Tokyo (JP); Hiroyuki Ueyama, Tokyo (JP); Hiroyuki Kaneko, Tokyo (JP); Junitsu Yamakawa, Tokyo (JP); Akihisa Hongo, Tokyo (JP); Ryoichi Kimizuka, Tokyo (JP); Megumi Maruyama, Kanagawa (JP)

(73) Assignee: Ebara Corporation, Tokyo (JP)

( * ) Notice: Subject to any disclaimer, the term of this patent is extended or adjusted under 35 U.S.C. 154(b) by 228 days.

(21) Appl. No.: 10/627,684

(22) Filed: Jul. 28, 2003

(65) Prior Publication Data

US 2004/0016644 A1 Jan. 29, 2004

Related U.S. Application Data

(62) Division of application No. 09/830,407, filed on Apr. 27, 2001, now Pat. No. 6,627,066.

(30) Foreign Application Priority Data

Aug. 30, 1999 (JP) ..... 11-243441
Aug. 31, 1999 (JP) ..... 11-244582

(51) Int. Cl.
*C25D 21/14* (2006.01)
*C25D 7/12* (2006.01)

(52) U.S. Cl. ..... 205/82; 205/101

(58) Field of Classification Search ..... None
See application file for complete search history.

(56) References Cited

U.S. PATENT DOCUMENTS

| | | | | |
|---|---|---|---|---|
| 3,674,672 A | | 7/1972 | Whitesell | |
| 4,132,605 A | | 1/1979 | Tench et al. | |
| H36 H | * | 3/1986 | Smith | 205/81 |
| 4,624,857 A | | 11/1986 | Dahms | |
| 5,192,403 A | | 3/1993 | Chang et al. | |
| 5,223,118 A | | 6/1993 | Sonnenberg et al. | |
| 5,352,350 A | * | 10/1994 | Andricacos et al. | 205/101 |
| 6,113,769 A | * | 9/2000 | Uzoh et al. | 205/101 |

FOREIGN PATENT DOCUMENTS

| | | |
|---|---|---|
| EP | 0 154 705 | 9/1985 |
| JP | 4-74898 | 3/1992 |
| JP | 5-106100 | 4/1993 |

OTHER PUBLICATIONS

Gluzmann et al., Proc. AESF Annu. Tech. Conf. (1992), 79th (v.2), pp. 719-728.
Freitag et al., Plat. and Surf. Fin., 70(10), 1983, pp. 55-60.

* cited by examiner

*Primary Examiner*—Harry D. Wilkins, III
(74) *Attorney, Agent, or Firm*—Wenderoth, Lind & Ponack, L.L.P.

(57) ABSTRACT

The concentration of a leveler in a plating liquid that is used by a plating apparatus for filling metal such as copper in interconnection trenches and holes defined in the surface of a semiconductor substrate or the like is determined based on a peak area (Ar value) in a peel-off region of the plating liquid measured according to a CV or CVS process.

4 Claims, 3 Drawing Sheets

METHOD OF MANAGING A PLATING LIQUID USED IN A PLATING APPARATUS

This application is a Divisional application of Ser. No. 09/830,407, filed Apr. 27, 2001, now U.S. Pat. No. 6,627,066.

TECHNICAL FIELD

The present invention relates to a method of measuring the concentration of a leveler in a plating liquid that is used by a plating apparatus for filling metal such as copper in interconnection trenches and holes defined in the surface of a semiconductor substrate or the like, and a method of and an apparatus for managing a plating liquid to manage the components thereof.

BACKGROUND ART

For filling interconnection trenches and holes defined in the surface of a semiconductor substrate or the like according to a copper sulfate electroplating process, it is often customary to add three organic additives, described below, to basic plating liquid components copper sulfate ($CuSO4.5H2O$), sulfuric acid ($H2SO4$), and chlorine (Cl) in order to improve the qualities of a plated film and increase the fillability (embeddability) of trenches and holes.

One of the three organic additives is a carrier (also referred to as a brightener) for making the plated film dense and for increasing the luster of the plated film. The carrier generally comprises a sulfuric compound (e.g., HS—CnH2n-SO3 Mercapto alkylsulfonic acid) and exists as an anion in a plating liquid. The carrier obstructs the deposition of copper ions and promotes the achievement of a finer structure of the plated film.

The second of the three organic additives is a polymer (also referred to as a suppressor or a carrier) for suppressing the deposition of adsorbed copper ions on the surface of a cathode thereby to increase activated polarization for increased uniform electrodeposition. The polymer generally comprises a surface-active agent such as PEG or PPG.

The third organic additive is a leveler comprising a nitrogen-containing compound such as polyamine or the like. The leveler is present as a cation in a plating liquid.

The leveler is adsorbed greatly in a region where the current density is high. In the region where the adsorption of the leveler is large, an activation overvoltage increases to suppress the deposition of copper. At the bottom of fine trenches and holes, however, the adsorption of the leveler is smaller, resulting in a larger amount of the deposition of copper. The deposited state with the raised bottom represents an excellent leveling capability.

The management of the concentration of additives in a plating liquid of copper sulfate is important in managing the qualities of a plated film and the embeddability of trenches and holes. However, no process is presently available for measuring the absolute concentration of a trace of organic compound in a strong acid.

The present general process of analyzing the concentration of additives in a plating liquid is called a CV (Cyclic Voltammetric) process or a CVS (Cyclic Voltammetric Stripping) process. According to this process, the amount of copper deposited on a rotating cathode electrode is measured and converted into the concentration of an additive referred to as a deposition inhibitor or promoter.

In a plating solution of copper sulfate, however, only the concentrations of the carrier and the polymer can be measured by the above process, and the concentration of the leveler cannot be measured by the above process. The concentration of the leveler is the smallest among the concentrations of the above three additives. The leveler has properties similar to those of the polymer, and it has been said that it is impossible to measure the concentration of the leveler even according to the CV or CVS process.

A method of managing and adjusting the components of a plating liquid used by a plating apparatus of the type described above will be described below. Consumed amounts of the components of a plating liquid are empirically determined when the plating apparatus starts to operate in a plating mode and also when the plating apparatus is operating in a steady mode. Depending on a quantity of electricity (current×time), an initial startup replenishing liquid (starter) is added to a base plating liquid. In a subsequent operation, a replenishing liquid (replenisher) is appropriately supplied to manage and adjust the components of the plating liquid. The starter comprises additive component liquids mixed depending on the consumed amounts of the components at the time of starting the plating apparatus. Similarly, the replenisher also comprises additive component liquids mixed depending on the consumed amounts of the components at the time of normal operation of the plating apparatus.

The empirical process has been used because it has been difficult to analyze the concentrations of the additives. However, since it is difficult to manage the concentrations accurately and the added amounts of the components are predetermined, this process finds it difficult to cope with a situation where the consumed amounts of the components are brought out of balance due to time-depending changes in the plating conditions.

There has recently been proposed an automatic analyzing device for quickly analyzing and automatically measuring additives according to an electrochemical process.

SUMMARY OF THE INVENTION

The present invention has been made in view of the above difficulties. It is an object of the present invention to provide a method of measuring the concentration of a leveler which is an additive in a plating liquid of copper sulfate, which has been impossible to measure according to a conventional CV or CVS process.

Another object of the present invention is to provide a method of and an apparatus for managing a plating liquid to automatically analyze additives of the plating liquid and adjust the components of the plating liquid based on the analyzed results.

In particular, a method of measuring the concentration of a leveler in a plating liquid of copper sulfate to measure the concentration of an additive containing nitrogen, which is referred to as a leveler, among organic additives contained in an electroplating liquid of copper sulfate is provided. The concentration of the leveler in the plating solution is determined based on a peak area (Ar value) in a peel-off region of the plating liquid measured according to a CV or CVS process.

Alternatively, a method of measuring the concentration of a leveler in a plating liquid of copper sulfate to measure the concentration of an additive containing nitrogen, which is referred to as a leveler, among organic additives contained in an electroplating liquid of copper sulfate is provided. The concentration of a brightener (carrier), and a wetting agent or a polarizing agent (polymer), which are other organic additives of the plating liquid, are analyzed. Thereafter, a calibration curve for the concentration of the leveler using a standard liquid prepared with the concentration of the carrier and the concentration of the polymer is generated. The concentration of the leveler of the plating liquid is determined based on a peak area (Ar value) in a peel-off region of the plating liquid measured according to a CV or CVS process.

As another alternative, a method of measuring the concentration of a leveler in a plating liquid of copper sulfate to measure the concentration of an additive containing nitrogen, which is referred to as a leveler, among organic additives contained in an electroplating liquid of copper sulfate is provided. A measuring liquid containing a promoting additive containing a sulfur-based material, which is referred to as a carrier, is prepared at a concentration that is 2 to 40 times a standard concentration. A difference in the amount of copper deposition on a rotary electrode according to a CV or CVS process is measured to calculate the concentration of the leveler.

The performance of the leveler in the plating solution of copper sulfate is not determined by the concentration of the leveler alone, but is affected by the concentrations of the carrier and the polymer. Particularly, the concentration of the carrier affects the leveling capability. If a nondye nitrogen compound such as polyamine or the like is used as the leveler, then the leveling nature becomes distinct, allowing a calibration curve to be drawn clearly, by increasing the concentration of the carrier in the plating liquid to be analyzed, relatively 2 to 40 times.

As another alternative, a method of measuring the concentration of a leveler in a plating liquid of copper sulfate to measure the concentration of an additive containing nitrogen, which is referred to as a leveler, among organic additives contained in an electroplating liquid of copper sulfate is provided. The plating liquid is passed through an organic anion-selective adsorption film to remove the promoting additive containing a sulfur-based material, which is referred to as a carrier, from the plating liquid. Thereafter, a difference in an amount of copper deposition on a rotary electrode is measured according to a CV or CVS process to calculate the concentration of the leveler.

If a nitrogen compound such as yanus green is used as the leveler, then the leveling nature becomes distinct, allowing a calibration curve to be drawn clearly, by bringing the amount of carrier closely to zero. Therefore, by passing the plating liquid through the organic anion-selective adsorption film, the carrier can be removed from the plating liquid, and a calibration curve can be drawn clearly.

Another method of managing a plating liquid includes sampling, at a predetermined interval, a predetermined amount of plating liquid in a plating apparatus which immerses a substrate to be plated in the plating liquid to plate a surface of the substrate. Components of the sampled plating liquid are analyzed with an automatic analyzing device, and component replenishing liquids comprising components of the plating liquid are supplied to the plating liquid based on analyzed results and/or the number of substrates to be plated and a quantity of electricity consumed to plate the substrates for thereby managing the components of the plating liquid. The component replenishing liquids comprise a standard liquid, a plurality of solutions of a basic liquid with a plurality of different additives added thereto, sulfuric acid, and hydrochloric acid, either wholly or partly, and the component replenishing liquids are supplied to the plating liquid for thereby individually replenishing and managing the components of the plating liquid.

In the above method, the basic liquid comprises a solution of at least copper sulfate ($CuSO_4.5H_2O$), and sulfuric acid ($H_2SO_4$), mixed at predetermined ratios. The standard liquid comprises a solution of the basic liquid, and the plurality of additives and hydrochloric acid added thereto at predetermined ratios.

A total amount of component replenishing liquids to be supplied to the plating liquid can be substantially the same as a reduction in the plating liquid which is caused by plating the substrate.

An apparatus is provided for managing the components of a plating liquid in a plating apparatus which immerses a substrate to be plated in the plating liquid in a plating tank to plate a surface of the substrates. The apparatus includes a plating liquid sampling device for sampling a predetermined amount of the plating liquid at a predetermined interval, an automatic analyzing device for automatically analyzing the components of the plating liquid sampled by the plating liquid sampling device, and a component replenishing liquid supply device for supplying component replenishing liquids comprising the components of the plating liquid. The component replenishing liquids are supplied to the plating liquid based on analyzed results from the automatic analyzing device and/or the number of substrates to be plated and a quantity of electricity consumed to plate the substrates for thereby managing the components of the plating liquid. The component replenishing liquids comprise a standard liquid, a plurality of solutions of a basic liquid with a plurality of different additives added thereto, sulfuric acid, and hydrochloric acid, either wholly or partly, and the component replenishing liquids are supplied by the component replenishing liquid supply device to the plating liquid for thereby individually replenishing and managing the components of the plating liquid.

In the above apparatus, the basic liquid comprises a solution of at least copper sulfate ($CuSO_4.5H_2O$), and sulfuric acid ($H_2SO_4$), mixed at predetermined ratios. The standard liquid comprises a solution of the basic liquid and the plurality of additives and hydrochloric acid added thereto at predetermined ratios.

The apparatus described above can include a plating liquid adjusting tank, separate from the plating tank, for supplying the component replenishing liquids to the plating liquid.

DETAILED DESCRIPTION OF THE INVENTION

Figure 1:
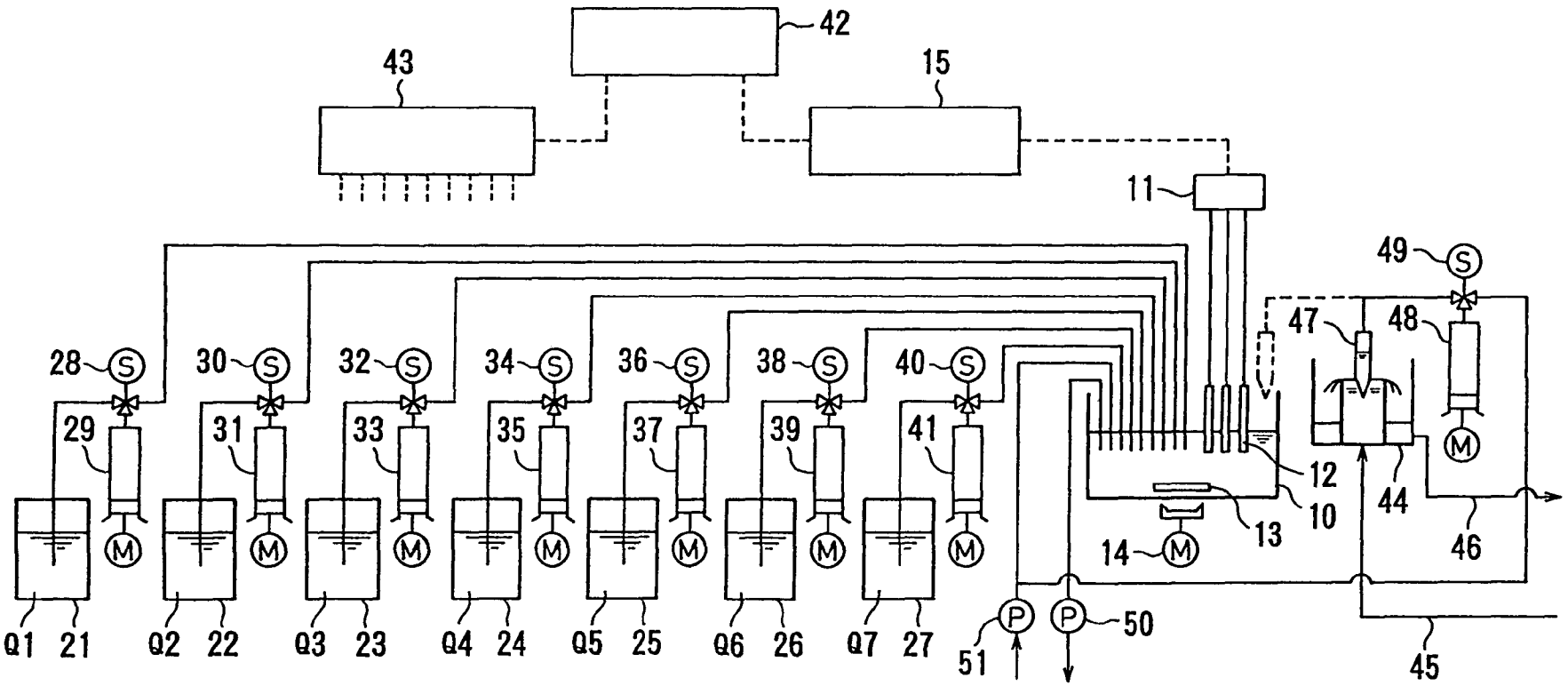
FIG. 1 is a diagram showing an arrangement of an apparatus for carrying out a method of measuring the concentration of a leveler in a plating liquid according to the present invention.

An embodiment of the present invention will hereinafter be described with reference to the drawings. FIG. 1 is a diagram showing an arrangement of an apparatus (automatic analyzing device) for carrying out a method of measuring the concentration of a leveler in a plating liquid of copper sulfate according to the present invention. In FIG. 1, the apparatus has a measurement cell 10 housing therein rotary disk electrodes 12 held by an electrode holder 11 and a stirring impeller 13 that can be driven in a contactless manner by a stirrer 14. A potentiostat 15 for automatically adjusting currents to bring the potentials between the electrodes into a desired setting is connected to the electrode holder 11.

A low-concentration basic liquid tank 21 holds a low-concentration basic liquid Q1 therein. A high-concentration basic liquid tank 22 holds a high-concentration basic liquid Q2 therein. A checking liquid tank 23 holds a checking liquid Q3 therein. A first additive liquid tank 24 holds an additive A (polymer) liquid Q4 therein. A second additive liquid tank 25 holds an additive B (carrier) liquid Q5 therein. A third additive liquid tank 26 holds an additive C (leveler) liquid Q6 therein. A standard liquid tank 27 holds a standard liquid Q7 therein. The basic liquid comprises a solution of copper sulfate (CuSO4.5H2O), and sulfuric acid (H2SO4), mixed at predetermined ratios. The standard liquid comprises a solution of the basic liquid and a plurality of additives and hydrochloric acid that are added thereto at predetermined ratios. The checking liquid comprises a solution for checking the polymer, the solution containing the basic liquid and a certain amount of additive mixed therewith.

A burette 29 is connected to the low-concentration basic liquid tank 21 through a three-way valve 28 for extracting a certain amount of low-concentration basic liquid Q1 from the low-concentration basic liquid tank 21 and supplying the extracted amount of low-concentration basic liquid Q1 into the measurement cell 10. Burettes 31, 33, 35, 37, 39, 41 are connected respectively to the high-concentration basic liquid tank 22, the checking liquid tank 23, the additive liquid tank 24, the additive liquid tank 25, the additive liquid tank 26, and the standard liquid tank 27 through respective three-way valves 30, 32, 34, 36, 38, 40 for supplying certain amounts of high-concentration basic liquid Q2, checking liquid Q3, additive A liquid Q4, additive B liquid Q5, additive C liquid Q6, and standard liquid Q7, and for supplying the extracted amounts of high-concentration basic liquid Q2, checking liquid Q3, additive A liquid Q4, additive B liquid Q5, additive C liquid Q6, and standard liquid Q7 into the measurement cell 10.

A controller 42 comprising a CPU controls a driver 43 for switching the three-way valves 28, 30, 32, 34, 36, 38,40 and activating and inactivating the burettes 29, 31, 33, 35, 37, 39, 41 depending on a polymer concentration measuring mode, a carrier concentration measuring mode, and a leveler concentration measuring mode, described below, and also controls various other parts.

A sample tank 44 holds a sample plating liquid whose concentration is to be measured. The sample plating liquid flows from a sample inlet port 45 into the sample tank 44, overflows the sample tank 44, and returns from a sample return port 46 to a plating apparatus (not shown). A sample nozzle 47 is positioned above the sample tank 44 and is connected to a burette 48 through a three-way valve 49. The burette 48 extracts a certain amount of sample plating liquid from the sample tank 44 via the sample nozzle 47. After the sample nozzle 47 is moved to a position over the measuring cell 10, the burette 48 supplies the extracted sample plating liquid into the measuring cell 10.

A pump 51 for delivering pure water is connected to the burette 48 and the sample nozzle 47 via the three-way valve 49 to wash them. The interior of the measurement cell 10 is also washed by pure water. The solution in the measurement cell 10 is drained by a pump 50.

The polymer concentration measuring mode for measuring a polymer concentration, the carrier concentration measuring mode for measuring a carrier concentration, and the leveler concentration measuring mode for measuring a leveler concentration, which are carried out by the concentration measuring apparatus thus constructed, will be described below by way of example.

[Polymer Concentration Measuring Mode]

First, it is confirmed that the electrodes 12 are stable by extracting 50 ml of low-concentration basic liquid Q1 from the low-concentration basic liquid tank 21, supplying the extracted low-concentration basic liquid Q1 to the measurement cell 10, determining an Ar value, i.e., a peak area (time×current density=quantity of electricity) in a peel-off region according to the CVS process, and deciding whether the Ar value is an appropriate value or not. If the Ar value is not an appropriate value, the low-concentration basic liquid Q1 is drained from the measurement cell 10, the measurement cell 10 is washed, 50 ml of low-concentration basic liquid Q1 is again extracted, the extracted low-concentration basic liquid Q1 is supplied to the measurement cell 10, and the above cycle is repeated.

If the Ar value is an appropriate value, then 1 ml of checking liquid Q3 is extracted from the checking liquid tank 23 and supplied to the measurement cell 10, and an Ar value is measured according to the CVS process. The cycle of extracting and supplying the checking liquid Q3 and measuring an Ar value according to the CVS process is repeated a predetermined number of times (usually five times, at most 10 times) to draw a calibration curve. When the calibration curve has been drawn, the liquid in the measurement cell 10 is drained, and the interior thereof is washed.

Then, 50 ml of low-concentration basic liquid Q1 is extracted from the low-concentration basic liquid tank 21 and supplied to the measurement cell 10, and it is decided whether an Ar value is an appropriate value or not (to confirm that the electrodes 12 are stable). If the Ar value is an appropriate value, then 1 ml of sample plating liquid (specimen) is extracted and added to the liquid in the measurement cell 10, and an Ar value is measured according to the CVS process. The cycle of extracting and supplying the sample liquid and measuring an Ar value according to the CVS process is repeated a predetermined number of times (usually five times, at most 10 times) to draw a calibration curve. When the calibration curve has been drawn, the liquid in the measurement cell 10 is drained, and the interior thereof is washed.

A polymer concentration of the sample plating liquid is determined from a comparison between the above two calibration curves. Specifically, since the polymer concentration of the checking liquid Q3 is known, the polymer concentration of the sample plating liquid can be determined by comparing the calibration curve obtained from the checking liquid Q3 and the calibration curve of the sample plating liquid.

[Carrier Concentration Measuring Mode]

As with the above polymer concentration measuring mode, it is confirmed that the electrodes 12 are stable by extracting 50 ml of low-concentration basic liquid Q1 from the low-concentration basic liquid tank 21, supplying the extracted low-concentration basic liquid Q1 to the measurement cell 10, measuring an Ar value according to the CVS process, and confirming that the Ar value is an appropriate value.

If it is confirmed that the Ar value is an appropriate value, then the low-concentration basic liquid Q1 is drained from the measurement cell 10 and the measurement cell 10 is washed. Thereafter, 48.5 ml of high-concentration basic liquid Q2 is extracted from the high-concentration basic liquid tank 22, 1 ml of additive A liquid Q4 is extracted from the additive liquid tank 24, and 0.5 ml of additive C liquid Q6 is extracted from the additive liquid tank 26. The extracted liquids are supplied to the measurement cell 10, and an Ar value is measured according to the CVS process. Then, 0.5 ml of additive B liquid Q5 is extracted from the additive liquid tank 25 and supplied to the measurement cell 10, and an Ar value is measured according to the CVS process. The cycle of extracting 0.5 ml of additive B liquid Q5 from the additive liquid tank 25 and supplying the extracted additive B liquid Q5 to the measurement cell 10 and measuring an Ar value according to the CVS process is repeated a predetermined number of times (usually four times) to draw a calibration curve. The measured data are determined, and if the measured data are appropriate, then the liquid in the measurement cell 10 is drained and the interior of the measurement cell 10 is washed.

Then, it is confirmed again that the electrodes 12 are stable by extracting 50 ml of low-concentration basic liquid Q1 from the low-concentration basic liquid tank 21, supplying the extracted low-concentration basic liquid Q1 to the measurement cell 10, measuring an Ar value according to the CVS process, and confirming that the Ar value is an appropriate value.

If it is confirmed that the Ar value is an appropriate value, then the low-concentration basic liquid Q1 is drained from the measurement cell 10 and the measurement cell 10 is washed. Thereafter, 99.6 ml of sample plating liquid is extracted and supplied to the measurement cell 10, and 1 ml of additive A liquid Q4 is extracted from the additive liquid tank 24 and added to the liquid in the measurement cell 10. An Ar value is measured according to the CVS process, and a carrier concentration of the sample plating liquid is measured from the calibration curve shown in FIG. 2 based on the measured Ar value.

[Leveler Concentration Measuring Mode]

A leveler concentration can be measured according to three methods. These leveler concentration measuring methods will be described below.

In an example of the leveler concentration measuring method according to the invention, it is confirmed that the electrodes 12 are stable by extracting 100 ml of low-concentration basic liquid Q1 from the low-concentration basic liquid tank 21, supplying the extracted low-concentration basic liquid Q1 to the measurement cell 10, measuring an Ar value according to the CVS process, and confirming that the Ar value is an appropriate value.

If it is confirmed that the Ar value is an appropriate value, then the low-concentration basic liquid Q1 is drained from the measurement cell 10 and the measurement cell 10 is washed. Thereafter, 48 ml of high-concentration basic liquid Q2 is extracted from the high-concentration basic liquid tank 22, 1 ml of additive A liquid Q4 is extracted from the additive liquid tank 24, and 1 ml of additive B liquid Q5 is extracted from the additive liquid tank 25. The extracted liquids are supplied to the measurement cell 10, and an Ar value is measured according to the CVS process.

Figure 2:
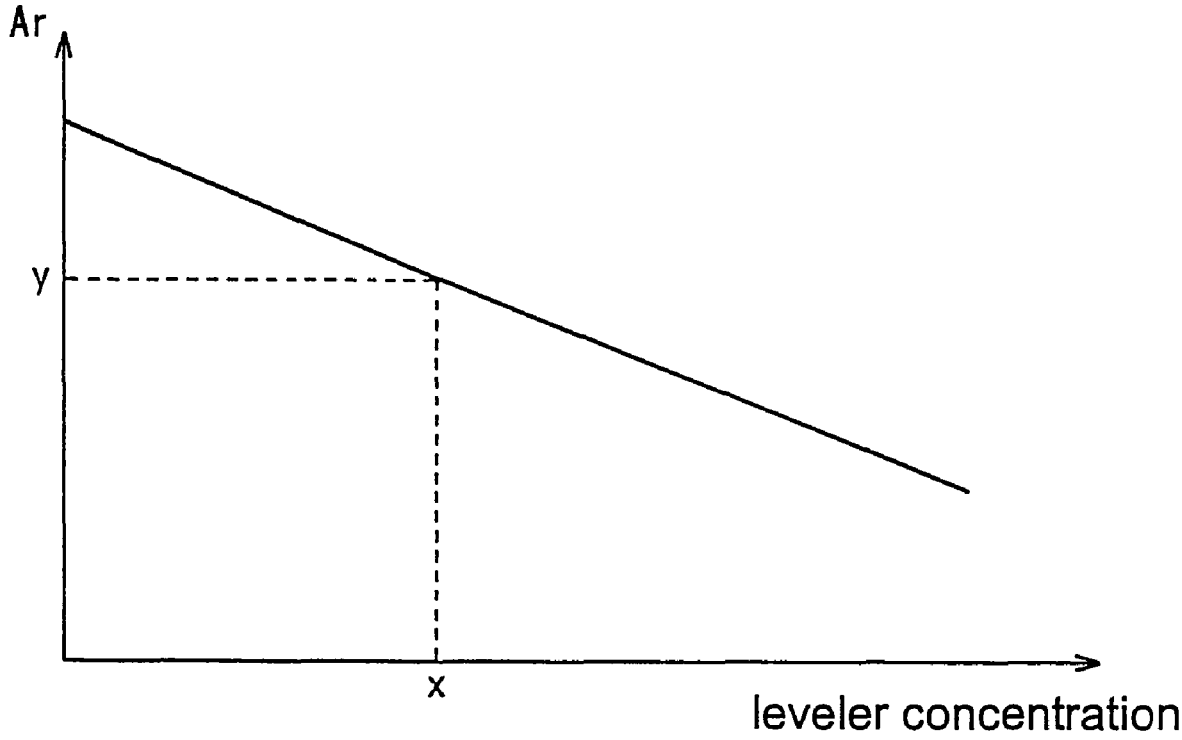
FIG. 2 is a diagram showing the relationship between the concentration of a leveler and the calibration curve for Ar values.

Then, 0.1 ml of additive C liquid Q6 is extracted from the additive liquid tank 26 and supplied to the measurement cell 10, and an Ar value is measured according to the CVS process. The cycle of extracting 0.1 ml of additive C liquid Q6, supplying the extracted additive C liquid Q6 to the measurement cell 10, and measuring an Ar value according to the CVS process is repeated a predetermined number of times (usually four times) to draw a calibration curve as shown in FIG. 2. The measured data are determined, and if the measured data are appropriate, then the liquid in the measurement cell 10 is drained and the interior of the measurement cell 10 is washed.

50 ml of sample plating liquid is extracted and supplied to the measurement cell 10, and an Ar value is measured according to the CVS process. A leveler concentration of the sample plating liquid is measured from the calibration curve shown in FIG. 2 based on the measured Ar value. If the Ar value of the sample plating liquid is represented by y in FIG. 2, then the corresponding leveler concentration is determined as x.

In a further leveler concentration measuring method, after it is confirmed that the electrodes 12 are stable, a certain amount of high-concentration basic liquid Q2 is extracted from the high-concentration basic liquid tank 22, and a certain amount of additive B liquid Q5 is extracted from the additive liquid tank 25 such that its concentration is 2 to 40 times the above concentration (high-concentration basic liquid Q2+additive B liquid Q5=50 ml). The extracted liquids are supplied to the measurement cell 10, and an Ar value is measured according to the CVS process.

Then, 0.1 ml of additive C liquid Q6 is extracted from the additive liquid tank 26 and supplied to the measurement cell 10, and an Ar value is measured according to the CVS process. The cycle of extracting 0.1 ml of additive C liquid Q6 and supplying the extracted additive C liquid Q6 to the measurement cell 10 and measuring an Ar value according to the CVS process is repeated a predetermined number of times (usually four times) to draw a calibration curve (not shown). The measured data are determined, and if the measured data are appropriate, then the liquid in the measurement cell 10 is drained and the interior of the measurement cell 10 is washed.

50 ml of sample plating liquid is extracted and supplied to the measurement cell 10, and an Ar value is measured according to the CVS process. A leveler concentration of the sample plating liquid is measured from the calibration curve based on the measured Ar value.

In a leveler concentration measuring method according to the present invention, after it is confirmed that the electrodes 12 are stable, 49 ml of high-concentration basic liquid Q2 is extracted from the high-concentration basic liquid tank 22, and 1 ml of additive A liquid Q4 is extracted from the additive liquid tank 24. The extracted liquids are supplied to the measurement cell 10, and an Ar value is measured according to the CVS process.

Then, 0.1 ml of additive C liquid Q6 is extracted from the additive liquid tank 26 and supplied to the measurement cell 10, and an Ar value is measured according to the CVS process. The cycle of extracting 0.1 ml of additive C liquid Q6 and supplying the extracted additive C liquid Q6 to the measurement cell 10 and measuring an Ar value according to the CVS process is repeated a predetermined number of times (usually four times) to draw a calibration curve (not shown). The measured data are determined, and if the measured data are appropriate, then the liquid in the measurement cell 10 is drained and the interior of the measurement cell 10 is washed.

50 ml of sample plating liquid from which the carrier has been removed by passing the plating liquid through an organic anion-selective adsorption film is extracted and supplied to the measurement cell 10. An Ar value is measured according to the CVS process, and a leveler concentration of the sample plating liquid is measured from the calibration curve based on the measured Ar value.

With a number of leveler calibration curves for different carrier and polymer concentrations being stored in the computer of the controller 42, the concentration measuring apparatus of the above construction is capable of analyzing samples easily within a short period of time.

According to the above methods of measuring the concentration of a leveler, it is possible to measure the concentration of a leveler in a plating liquid, which could not heretofore be measured according to the CV or CVS process.

Figure 3:
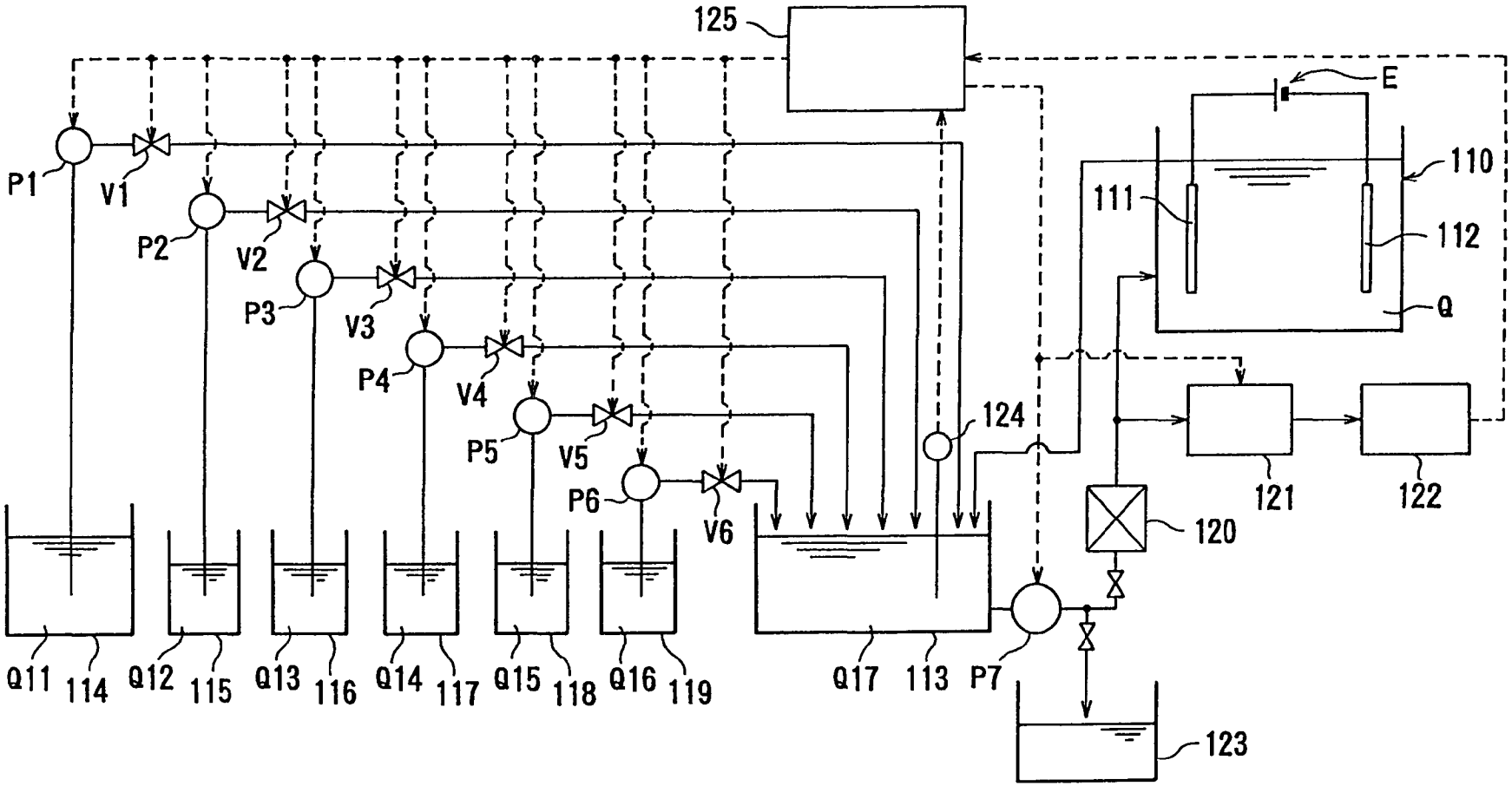
FIG. 3 is a diagram showing an arrangement of a plating liquid managing apparatus for carrying out a method of managing the components of a plating liquid according to the present invention.

FIG. 3 is a diagram showing an arrangement of a plating liquid managing apparatus which incorporates the automatic analyzing device for plating liquids shown in FIG. 1. The plating liquid managing apparatus has a plating tank 110 holding a plating liquid Q therein. An anode electrode plate 111 and a substrate 112 to be plated are placed in the plating tank 110 so as to confront (face) each other. When a plating current is supplied between the anode electrode plate 111 and the substrate 112 to be plated from a plating power supply E, the surface of the substrate 112 is plated according to an electroplating process.

A plating liquid adjusting tank 113 for adjusting a plating liquid can be supplied with a standard liquid Q11 from a standard liquid tank 114 through a pump P1 and a valve V1, a replenishing liquid Q12, which comprises the basic liquid and the additive A mixed therein, from a first replenishing liquid tank 115 through a pump P2 and a valve V2, a replenishing liquid Q13, which comprises the basic liquid and the additive B mixed therein, from a second replenishing liquid tank 116 through a pump P3 and a valve V3, a replenishing liquid Q14, which comprises the basic liquid and the additive C mixed therein, from a third replenishing liquid tank 117 through a pump P4 and a valve V4, sulfuric acid (H2SO4) Q15 from a sulfuric acid tank 118 through a pump P5 and a valve V5, and hydrochloric acid (HCl) Q16 from a hydrochloric acid tank 119 through a pump P6 and a valve V6.

A plating liquid Q17 which has been adjusted in the plating liquid adjusting tank 113 is supplied to the plating tank 110 through a filter 120 by a pump P7. The plating liquid Q in excess of a certain level in the plating tank 110 is returned to the plating liquid adjusting tank 113. Therefore, the plating liquid circulates between the plating liquid adjusting tank 113 and the plating tank 110.

The plating liquid Q7 supplied to the plating tank 110 is sampled by a sampling device 121. The components of the plating liquid Q17 sampled by the sampling device 121 are automatically analyzed by an automatic analyzing device 122. The plating liquid managing apparatus has a drain tank 123, and a level sensor 124 for measuring a plating liquid level in the plating liquid adjusting tank 113, and a controller 125.

The controller 125 receives the analyzed results of the components of the plating liquid 17 analyzed by the automatic analyzing device 122 and the plating liquid level measured by the level sensor 124. Based on the analyzed results of the components of the plating liquid Q17 analyzed by the automatic analyzing device 122, the controller 125 controls the pumps P1–P6 and the valves V1–V6 to control the standard liquid Q11 supplied from the standard liquid tank 114, the replenishing liquid Q12 supplied from the replenishing liquid tank 115, the replenishing liquid Q13 supplied from the replenishing liquid tank 116, the replenishing liquid Q14 supplied from the replenishing liquid tank 117, the sulfuric acid Q15 supplied from the sulfuric acid tank 118, and the hydrochloric acid Q16 supplied from the hydrochloric acid tank 119 so as to adjust the components of the plating liquid Q17 in the plating liquid adjusting tank 113.

The plating liquid managing apparatus thus constructed operates as follows: When a plating process is to be started, certain amounts of replenishing liquids Q12, Q13, Q14 with the additives A, B, C mixed therewith may be added to the standard liquid Q11 from the standard liquid tank 114. The automatic analyzing device 122 automatically analyzes the concentrations of the additive A (polymer), the additive B (carrier), and the additive C (leveler), as described above, and also automatically analyzes the concentrations of Cu2+, H2SO4, and Cl−. These concentrations may automatically be analyzed according to a titrimetric analyzing process or a spectrophotometric analyzing process.

At the time of starting the plating process, since a variation of the concentrations of the components vary greatly, the sampling frequency for sampling the plating liquid with the sampling device 121 is set to a high value. While in the plating process, the replenishing liquids Q12, Q13, Q14 and the hydrochloric acid Q16 are individually supplied to the plating liquid Q17 in the plating liquid adjusting tank 113 in order to keep the concentrations of the components within a certain management range depending on the analyzed results from the automatic analyzing device 122.

When the concentrations of the components are stabilized, the sampling frequency for sampling the plating liquid with the sampling device 121 is set to a lower value, e.g., once every few hours. At this time, a process of supplying the replenishing liquids Q12, Q13, Q14 from the replenishing liquid tanks 115, 116, 117 at predetermined periods of time may be combined to compensate for the consumed amounts of additives that are empirically known depending on the quantity of electricity.

The plating liquid Q in the plating tank 110 is partly removed out of the system depending on the number of substrates 112 that are plated. The consumption of the components of the additives is also substantially proportional to the number of substrates 112 that are plated (integrated current value). Therefore, the removed amount of plating liquid and changes in the volumes of the additives can be kept in balance by properly adjusting in advance the concentrations of the components to be added.

For example, if the additives A, B, C are to be uniformly replenished, then the concentrations of the replenishing liquids Q12, Q13, Q14 are given as follows:

Concentration of an additive (mg/ml) in the component replenishing liquid=consumed amount (mg)/[removed amount×⅓ (ml)]

Actually, since the components in the plating liquid are reduced in fluctuations, the concentrations are made greater than, (e.g., about twice), the concentration given by the above equation, and the amounts of the component replenishing liquids of the additives are reduced and the replenishing liquid Q11 is replenished as the remainder. In this manner, the replenishing liquids in the adjusting tanks are prevented from being excessive.

With the above method of and apparatus for managing the plating liquid, as described above, component replenishing liquids comprise a standard liquid, a plurality of solutions of a basic liquid with a plurality of different additives added thereto, sulfuric acid, and hydrochloric acid, either wholly or partly. The component replenishing liquids are supplied to a plating liquid by a component replenishing liquid supply device. The additive can easily be managed individually, and the concentrations of the components can be managed more strictly. Thus, it is possible to produce uniform and homogeneous films of plated copper to provide highly reliable copper interconnections.

INDUSTRIAL APPLICABILITY

The present invention can be used to measure the concentration of a leveler in a plating liquid that is used by a plating apparatus for filling metal such as copper in interconnection trenches and holes defined in the surface of a semiconductor substrate or the like, and also to manage a plating liquid to manage the components thereof.

What is claimed is:

1. A method of managing a plating liquid used in a plating apparatus, said method comprising:

sampling the plating liquid;

analyzing components of the sampled plating liquid using an automatic analyzing device; and based on results of said analyzing, replenishing the plating liquid with component replenishing liquids containing the components of the plating liquid, a total amount of the component replenishing liquids to be supplied to the plating liquid is substantially equal to a reduction of an amount of the plating liquid caused by plating substrates in the plating apparatus, said replenishing comprising replenishing the plating liquid with component replenishing liquids each including:

a standard liquid; and a plurality of solutions each including:

a basic liquid including copper sulfate and sulfuric acid; and one of a plurality of different types of additives;

wherein the standard liquid includes the basic liquid, the plurality of different types of additives, and hydrochloric acid;

wherein said replenishing is performed in a manner so as to maintain concentrations of the components of the plating liquid within a certain management range.

2. The method of claim 1, wherein said replenishing is further based on a quantity of substrates plated by the plating apparatus, in addition to being based on the results of said analyzing.

3. The method of claim 1, wherein said replenishing is further based on a quantity of electricity consumed due to plating substrates in the plating apparatus, in addition to being based on the results of said analyzing.

4. The method of claim 1, further comprising changing a frequency of said sampling during an operation of the plating apparatus.

* * * * *